US005947918A

United States Patent [19]

Jones et al.

[11] Patent Number: 5,947,918

[45] Date of Patent: Sep. 7, 1999

[54] IMPACT ENERGY ABSORBING COMPOSITE MATERIALS

[75] Inventors: Carl H. Jones, Katy, Tex.; William B. Johnson, Newark, Del.; John M. Blaha, Chesapeake City, Md.

[73] Assignee: Gore Enterprise Holdings, Inc., Newark, Del.

[21] Appl. No.: 09/071,943

[22] Filed: May 4, 1998

Related U.S. Application Data

[63] Continuation-in-part of application No. 08/746,801, Nov. 18, 1996, Pat. No. 5,746,221.

[51] Int. Cl.[6] ..... A61F 13/00

[52] U.S. Cl. ..... 602/58; 602/41; 428/246; 424/30; 128/859

[58] Field of Search ..... 424/30; 128/859; 428/246; 602/41, 58

[56] References Cited

U.S. PATENT DOCUMENTS

| | | | |
|---|---|---|---|
| 1,934,688 | 11/1933 | Ackerman . | |
| 3,953,566 | 4/1976 | Gore . | |
| 3,962,153 | 6/1976 | Gore . | |
| 4,096,227 | 6/1978 | Gore . | |
| 4,187,390 | 2/1980 | Gore | 428/308 |
| 4,531,916 | 7/1985 | Scantlebury et al. . | |
| 4,896,664 | 1/1990 | Harayama . | |
| 4,985,296 | 1/1991 | Mortimer, Jr. . | |
| 5,103,838 | 4/1992 | Yousif . | |
| 5,152,301 | 10/1992 | Kittelsen et al. . | |
| 5,234,005 | 8/1993 | Kittelsen et al. . | |
| 5,288,552 | 2/1994 | Hollenbaugh, Jr. et al. . | |
| 5,339,832 | 8/1994 | Kittelsen et al. . | |
| 5,360,341 | 11/1994 | Abramowitz . | |
| 5,397,628 | 3/1995 | Crawley et al. | 428/246 |
| 5,401,234 | 3/1995 | Libin . | |
| 5,406,963 | 4/1995 | Adell . | |
| 5,471,906 | 12/1995 | Bachner, Jr. et al. . | |
| 5,570,702 | 11/1996 | Forman . | |
| 5,596,814 | 1/1997 | Zingle et al. . | |

FOREIGN PATENT DOCUMENTS

| | | |
|---|---|---|
| 0 302 596 | 2/1989 | European Pat. Off. . |
| 0 391 660 | 10/1990 | European Pat. Off. . |
| 2320501 | 11/1974 | Germany . |
| 96/22565 | 7/1996 | WIPO . |

OTHER PUBLICATIONS

Spiro J. Chaconas, Angelo A. Caputo, Niles Bakke, "A Comparison of Athletic Mouthguard Materials," The American Journal of Sports Medicine, vol. 13, No. 3, 1985, pp. 193–197.

Bureau of Health Education and Audiovisual Services Council on Dental Materials, Instruments, and Equipment, "Mouth Protectors and sports Team Dentits," JADA, vol. 109, Jul. 1984.

ASTM Designation: F697–80, Standard practice for Care and Use of Mouthguard, 1992.

John M. Stenger, Edward A. Lawson, Jack M. Wright, James Ricketts, "Mouthguards: Protection against shock to head, neck and teeth," JADA, vol. 69, Sep. 1964, pp. 273–281.

Robert E. Golng, Ronald E. Loehman, Ming Sam Chan, "Mouthguard materials: their physical and mechanical properties," JADA, vol. 89, Jul. 1974, pp. 132–138.

(List continued on next page.)

*Primary Examiner*—Richard J. Apley
*Assistant Examiner*—Kelvin Hart
*Attorney, Agent, or Firm*—Allan M. Wheatcraft

[57] ABSTRACT

An impact energy absorbing composite material of expanded polytetrafluoroethylene (ePTFE) and an elastomer is disclosed. The composite is comprised of at least one layer of expanded polytetrafluoroethylene and at least one layer of an elastomer. The individual layer thicknesses of the ePTFE and elastomer are controlled to achieve superior high energy impact resistance. The invention herein provides a material having performance that also can be tailored to meet other design needs for a given application, for example, space considerations or comfort.

21 Claims, 3 Drawing Sheets

OTHER PUBLICATIONS

B. Westerman, P. M. Stringfellow, J. A. Eccleston, "Forces transmitted through EVA mouthguard materials of different types and thickness," Australian Dental Journal 1995; 40:6, pp. 389–391.

I. Lawrence Kerr, "Mouth Guards for the Prevention of Injuries in Contact Sports," Sports Medicine, 415–427 (1986).

Raymond A. Flanders, "Mouthguards and Sports Injuries," Illinois Dental Journal, Jjanuary–Feb. 1993, pp. 13–16.

David W. Johnson, Barrett J. Parker, "Athletic Mouth Guards–One Town's Approach," CDA Journal, Apr. 1993.

Ray Padila, Stewart Balikov, "Sports Denistry: Coming of Age in the '90's," CDA Journal, Apr. 1993, pp. 27, 29, 31, 33, 36.

Chris Smith, "The Sporting LIfe," AGD Impact/Nov. 1989. pp. 4, 6 8.

"MouthGuards On–Line!", Internet, Jan. 26, 1996.

IMPACT ENERGY ABSORBING COMPOSITE MATERIALS

This application is a continuation-in-part application of U.S. application Ser. No. 08/746,801, filed Nov. 18, 1996, now U.S. Pat. No. 5,746,221.

BACKGROUND OF THE INVENTION

1. Field of the Invention

The present invention relates to impact energy absorbing composite materials used in the protection of equipment or people.

2. Description of Related Art

Protecting bodies from high energy impacts has been a long-felt need in the design of many commonly used devices, ranging from the inside surfaces in automobiles, e.g., dashboards; to protective athletic gear, e.g., chest protectors and mouth guards; to shoes, e.g., heel inserts; to various bathroom fixtures, e.g., bathtubs. Further, it is often desirable in the design of mechanical equipment to protect against sudden unexpected impacts, e.g., when hand-held tools are accidentally dropped or when heavy objects fall on stationary equipment. One common solution is to affix a layer of a polymeric material, for example, a polymer foam, on or near the surface of either the body that is to be protected, or the surface that will be impacted. In the case of humans, the force felt by the body is reduced during impact, thereby reducing the risk of injury. Further, the material acts to reduce the body's acceleration and thereby its velocity in response to the impact. By so doing, these materials reduce the trauma of the impact. In the case of mechanical objects, the foam acts in a similar fashion to reduce the force and minimize the change in velocity felt by the impacting or impacted object, thus reducing or eliminating damage.

Various materials to protect people and objects from damage due to high energy impacts have been developed. These materials typically are open or closed cell foams of various thermoplastic polymers including polyurethanes, polyethylene, polystyrene, etc., as well as foams or dense bodies of elastomeric polymers, including silicones, ethylene vinyl acetate (commonly referred to as EVA), ethylene-propylene rubbers (commonly referred to as EPM), ethylene-propylene-diene rubbers (commonly referred to as EPDM), etc. The specific polymer used depends upon the details of the application, including the degree of protection required, the allowable thickness, the cost, the ability to process into the required shape, and so forth. For any given application, these factors generally narrow the candidate materials to just a few that are seen in commercial products. As just one example, some commercially available materials used for the specific application of heel inserts include Plastazote (Apex Foot Products, South Hackensack, N.J.), Pelite (Durr-Filauer Medical, Inc., Chattanooga, Tenn.), PPT (Panger Biomechanics Group, Deer Park, N.Y.), and Sorbothane (Sorbothane, Inc., Kent, Ohio). Plastizote and Pelite are polyethylene foams, PPT is an open-cell polyurethane foam, and Sorbothane is a visco-elastic polymer.

In addition to single materials that are used to reduce force from high energy impacts, various composite materials where two or more components are intimately mixed together have been described. Examples of these composites include mixtures of fibers and ultrahigh molecular weight polyethylene (U.S. Pat. No. 4,946,721, issued Aug. 7, 1990); composites of rigid hollow bodies in an elastomeric matrix (U.S. Pat. No. 4,101,704, Issued Jul. 18, 1978) as well as various compositions of different elastomers and various fillers, for example, mixtures of rubber and latex as described by Portin in U.S. Pat. No. 4,082,888, issued Apr. 4, 1978.

Although such composites do offer some improvement in certain situations, often a structural composite composed of two or more layers of different materials offers additional protection not available by any one homogenous material alone. Such composite laminate structures have been specifically developed for many different applications. Some examples include shock absorbing athletic padding comprising a thermoplastic foam and a cellular rubber (U.S. Pat. No. 3,607,601, issued Sept. 21, 1971), an oriented foam having a thermoplastic film bonded to the surface (U.S. Pat. No. 3,619,344, issued Nov. 9, 1971), an impact absorbing laminate consisting of a layer of impact absorbing foam, a finishing layer, and a thin outer skin of substantially water impermeable resinous material (U.S. Pat. No. 3,816,234 issued Jun. 11, 1974), a protective device for the center of the chest comprising a stiff material that may have laminar cross sections (U.S. Pat. No. 5,245,706, issued Sep. 21, 1993), a resilient vehicular energy absorbing panel comprising a polyurethane foam core with a flexible reinforcing layer (U.S. Pat. No. 5,580,651, issued Dec 3, 1996) and many others. One laminate available commercially for the specific application of heel inserts described above is Spenco (Spenco Medical Corp., Waco, Tex.), which is a neoprene rubber foam with a nylon covering.

Applications that require materials or structures to reduce force from high energy impacts are different and distinct from the those used to reduce vibration. Vibration damping materials or systems are required where undesired resonances in a mechanical system may be excited by normal perturbations. The suspension system in an automobile, for example, will exhibit large unwanted oscillations in response to road irregularities unless properly damped. Shock absorbers, which produce forces opposing the velocity of compression or elongation of the springs, are employed to provide appropriate damping and inhibit oscillations. Such damping systems or materials are designed for periodic or recurring random changes of well defined loads, whereas impact energy absorbing materials such as those described herein are designed specifically for one time or, at most, infrequent impacts of high energy. Further, the goal in vibration damping is typically to reduce the maximum displacement after a perturbation, whereas impact energy absorbing materials reduce the transmitted force and minimize velocity changes resulting from an impact.

One material that apparently has not been examined as a high energy impact absorbing material is expanded polytetrafluoroethylene (abbreviated ePTFE) comprising polymeric nodes interconnected by fibrils defining a microporous structure. The processing and properties of this material are described by Gore in U.S. Pat. No. 3,953,566 (hereinafter referred to as '566) issued Apr. 26, 1976. Although polytetrafluoroethylene (abbreviated PTFE) (e.g., DuPont Teflon® fluoropolymer) has been described by Moschetti and Smith in U.S. Pat. No. 5,245,706, issued Sep. 21, 1993, as a material that could be used to protect against an impact in athletic wear, specifically a chest protector, they did not recognize the use of expanded PTFE. This material, which is available commercially in many forms, e.g., in rod form from W. L. Gore and Associates as Joint Sealant, has very different properties than granular Teflon® fluoropolymer materials, as fully described in '566. Because of its porous structure, ePTFE could inherently offer high energy impact energy absorption capability in much the same manner as porous polymeric foams or other materials, both being densified upon impact, thereby reducing the force transmitted through the material. Unlike many foams, though, the ePTFE may recover some or all of its ability to absorb another high energy impact because of its high strength and stiffness.

Similarly, other porous versions of PTFE may also offer improved impact energy resistance compared to dense, granular PTFE. Several different types of such materials have been prepared, primarily for use as an electrical insulation. Examples include the materials disclosed in U.S. Pat. No. 4,304,713 issued Dec. 8, 1981 to Perelman, and U.S. Pat. No. 4,663,095 issued May 5, 1987 to Battais. In the '713 patent, a volatile chemical blowing agent and a chemical foaming agent are employed with a perflurorocarbon resin to provide a foamed cellular structure. In the '095 patent, a mixture of PTFE, an aromatic pore-forming agent (e.g., benzene), a foaming agent, and a lubricating oil are reported to produce a foamed insulation. Finally, alternative methods of forming ePTFE have been described, for example, by McGregor, et. al. in U.S. Pat. No. 5,429,869 issued Jul. 4, 1995. In the '869 patent, PTFE and expandable thermoplastic microspheres are mixed and subsequently heated to form a coherent three dimensional expanded PTFE structure. In none of these cases was the use of such materials as a protection against high energy impacts disclosed.

Despite the developments described above, there continues to be a need for better materials and composites that function to mediate the effect of high energy impacts. Accordingly, it is a primary purpose of the present invention to produce a material that is capable of providing improved protection from high energy impacts. Specifically, a material that reduces the force generated from an impact as well as reduces the magnitude of the velocity change resulting from the impacts is desirable.

It is a further purpose of the present invention to provide a material with improved protection from high energy impacts, even after multiple impacts, instead of being essentially destroyed after the first impact like many traditional foamed polymers.

It is another purpose of the present invention to provide impact energy resistant materials that can be formed into multiple shapes, and therefore can be used in a wide variety of applications where protection is required.

It is another purpose of this invention to provide impact energy absorbing materials in forms that are well-suited to applications in constrained layers or other geometries that provide performance enhancements. This invention provides materials, which in film, sheet, rod, or other forms, may be laminated, pressure bonded, adhesively bonded, ultrasonically welded, or otherwise mechanically coupled, within structures such as constrained layers to yield maximal protection from high energy impacts. In addition, the invention yields materials with sufficient mechanical strength and integrity to provide good performance characteristics, including structural integrity, in laminates or other structures where shock absorbancy is required in conjunction with long term mechanical integrity.

It is yet another purpose of the present invention to provide impact energy resistant materials that are smooth and comfortable to the touch when placed against the human body.

These and other purposes of the present invention will become evident from review of the following specification.

SUMMARY OF THE INVENTION

The instant invention is an impact energy absorbing composite material of ePTFE and an elastomer comprising at least one layer of expanded polytetrafluoroethylene and at least one layer of an elastomer. Although each individual component will function to mediate high energy impacts, the composite surprisingly performs far better when combined than either individual component. The invention herein also provides a material having performance that can be tailored to meet other design needs for a given application, for example, space considerations or comfort. This concept is novel, and provides a new class of composites for protection against high energy impacts.

The product of the invention is a composite of a film, sheet, or rod, that has a layer or layers of expanded PTFE and at least one layer of an elastomer. The thickness of each layer is controlled so that the composite has a specific composition as described more fully below. The ePTFE may include porous materials with a wide range of densities. The elastomer layer or layers may include a wide range of natural and synthetic elastomers.

Specifically, the impact energy absorbing article includes a layer of ePTFE having an ePTFE layer thickness and a density less than about 2.0 g/cm$^3$, and a layer of an elastomer having an elastomer layer thickness, wherein a ratio of the ePTFE layer thickness to the elastomer layer thickness is greater than or equal to 0.5. The ratio is more preferably greater than one, greater than three, and greater than ten, respectively. The density is preferably less than 1.5 g/cm$^3$, less than 1.0 g/cm$^3$, and less than 0.5 g/cm$^3$, respectively. The impact energy absorbing article may include a plurality of layers of ePTFE wherein the ratio of a sum of the ePTFE layer thickness of the plurality of ePTFE layers to the elastomer layer thickness is greater than 0.5. The impact energy absorbing article may include a plurality of layers of elastomer wherein the ratio of the ePTFE layer thickness to a sum of the elastomer layer thicknesses of the plurality of elastomer layers is greater than 0.5. The impact energy absorbing article may also include a plurality of layers of ePTFE and a plurality of layers of elastomer, wherein the ratio of a sum of the ePTFE layer thicknesses of the plurality of ePTFE layers to a sum of the elastomer layer thicknesses of the plurality of elastomer layers is greater than 0.5. The impact energy absorbing article may be used as a mouthguard, an athletic padding material, a component of a shoe, a prosthetic device, a protective helmet, padding to protect mechanical equipment, or a protective material on the interior of an automobile or other moving vehicle, among other applications.

DETAILED DESCRIPTION OF THE INVENTION

Figure 1:
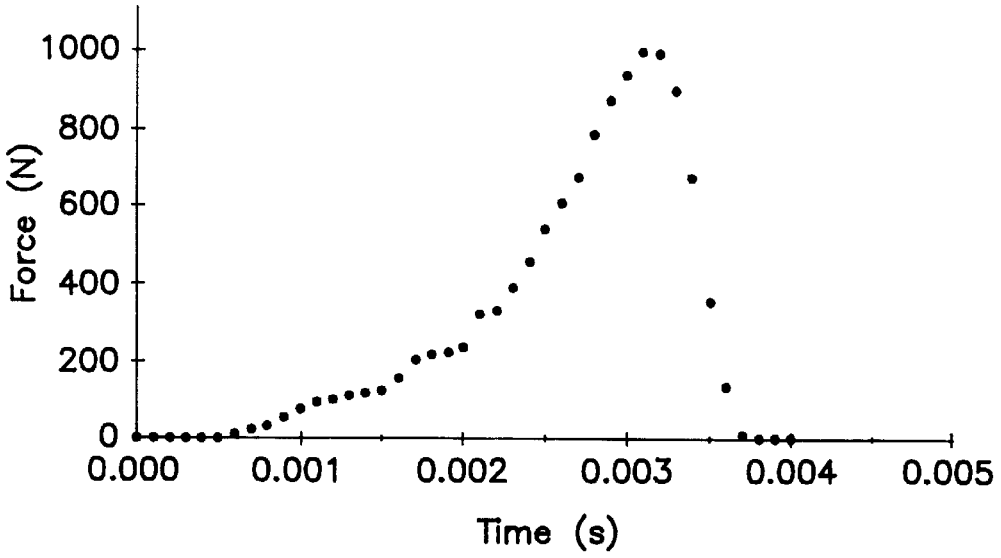
FIG. 1 is a graph plotting force generated as a function of time during impact with an exemplary embodiment of the present invention.

For the sake of understanding, it is necessary to more fully describe the nature of an impact of one solid object with another, for example, the impact of a hard ball with a human face. The important parameters that correlate with damage to the body in such cases are not well understood. Seeger et al. in U.S. Pat. No. 3,931,113 describe a factor known as the Severity Index, S.I., that has become identified with the relative safety of windshields when impacted by a dummy after acceleration along a sled into a windshield. The S.I. is given by $$S.I. = \int_0^t a_t^n dt,$$

where n has a value of 2.5, and $a_t$ is the deceleration in units of gravity at a given time, t, recorded by an accelerometer mounted in the dummy's head. The limits of integration are between the moment of the dummy's impact with the test windshield, t=0, and the time, t, when the accelerometer in the dummy's head records a negative load.

This test, although relevant to the specific testing of windshields, is not necessarily appropriate here because the inventive material being tested here will not crack and fail in a brittle manner like a windshield. Therefore, a different test was developed. We will show that the test measurement used here is different than, but related to, this S.I. metric.

The particular example chosen, impact of a ball or other solid object with the mouth, is illustrative because the damage possible, i.e., lost teeth and/or concussions, is easily described and mastered. But, it should be understood that the important parameters that are enumerated, force and change in velocity during the impact, are independent of the particular choice of impacting object or impacted body. In other words, the important parameters described hold for any impact of one hard object with another. Similar arguments to those presented below apply equally well to the impact of a mechanical object, for example a tool like an electric drill or an appliance like a hand mixer, with another hard object, like a countertop or floor.

Without wishing to be bound by any particular theory or explanation, the following description of an impact of a hard ball with a human face, in particular the mouth area, is presented. When a hard ball hits the mouth area, two damaging outcomes might occur:

1) a tooth or teeth will be broken or pulled out. This outcome occurs when the force generated during the impact generates a stress on a tooth greater than its fracture stress, or pull-out stress, respectively.
2) the individual develops a concussion. In this case, the impact causes the brain to collide with the skull causing trauma that results in a concussion. In this scenario, a fraction of the momentum of the ball is transferred to the head, and some fraction of that is in turn transferred to the brain inside the skull. (The momentum of a body is defined as its mass times its velocity). The brain collides into the skull causing trauma. The more momentum transferred to the brain, the faster it will hit the skull, and the more serious the damage will be.

Because it is desirable to avoid both of these outcomes, a protective device, in this case a mouth guard, can be worn. Accordingly, during an impact such a device should do two things: minimize the force felt by a tooth or teeth and reduce the speed at which the brain collides with the skull. As we will see, it may not be possible to completely achieve both of these goals simultaneously. In other words, a device that functions effectively to reduce the force felt by the teeth may not be as effective at reducing the speed with which the brain collides with the skull, or vice-versa.

To measure and compare the effectiveness of materials that could be used as a protective device, one must design a test to measure reduction of both force and speed. As described more fully below, an instrumented drop-test has been used. An anvil of fixed weight containing a force transducer is dropped from a known height onto a sample. The force exerted on the transducer by the material is recorded as a function of time. This force is equal to the force transmitted through the sample because of Newton's third law, every action must have an equal but opposite reaction. Additionally, the acceleration (or really decceleration) during the test can be determined from Newton's second law, $$\Sigma m_i * \vec{v}_i = 0$$

(summed over all bodies, i)

and the velocity during the test by integration of the acceleration. This velocity is directly related to the velocity of the head, and therefore the brain.

By way of further explanation, consider a body of mass, $m_b$, moving with velocity, $v_b^{in}$, that hits a head with mass, $m_h$, causing the head to move with velocity, $v_h$, and the body to rebound with velocity, $v_b^{out}$. Assuming there are no external forces acting on the system, the momentum must be conserved according to Newton's second law, i.e., $$\Sigma m_i * \vec{v}_i = 0$$

summed over all bodies, i. Therefore, $$m_b v_b^{in} - m_b v_b^{out} = m_h v_h$$

where the $v_b^{out}$ is negative because it is in the opposite direction of $v_b^{in}$ to correspond to the test described above. Simplifying, $$v_h = \frac{m_b * (v_b^{in} - v_b^{out})}{m_h}$$

or $$v_h = \frac{m_b * (\Delta v)}{m_h}$$

where ΔV is defined as the difference between the incoming and outgoing velocity of the body. Thus, the velocity of the head, and thereby the brain in the head, is directly proportional to ΔV. In the test described above, ΔV can be calculated by subtracting the initial velocity on impact, which is known from the basic laws of motion of a body from the final calculated velocity. For example, see R. Resnick and D. Halliday, *Physics*, John Wiley & Sons, 1966, pgs. 48–64.

Figure 2:
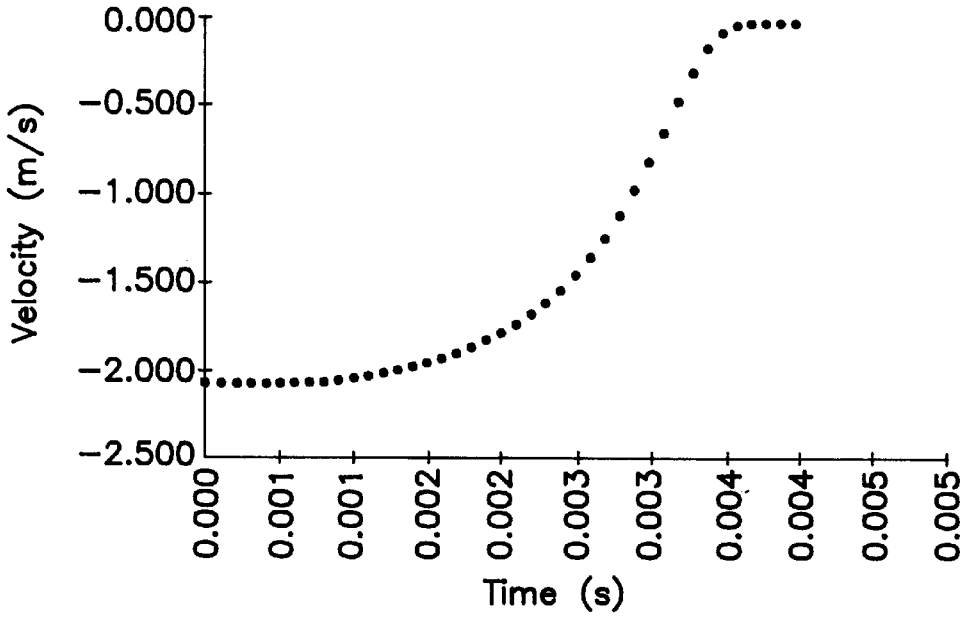
FIG. 2 is a graph plotting velocity as a function of time during impact with an exemplary embodiment of the present invention.

Therefore, the test described above will allow a ready comparison of different materials one could use in a protective device. Generally, the observed force (beginning at time t=0 when the mass first contacts the sample) increases and reaches some maximum value before decreasing to zero during the test (See FIG. 1, which is a plot of force versus time for an exemplary one of the samples tested in the Examples below). The maximum observed force, i.e., the peak in FIG. 1, will correspond to the value that would cause the most potential for damage, so this value is extracted as one parameter used to measure the effectiveness of a material in impact absorption. The velocity has a maximum downward value, arbitrarily defined as a negative speed, at impact (time t=0), changing to zero or a positive (i.e., anvil moving back upward) value during the test (FIG. 2, which is a plot of velocity versus time for an exemplary one of the samples tested in the Examples below). The ΔV is the difference between the initial and final velocities. This is the second value used to measure the effectiveness of the material in protecting bodies during an impact. This value is calculated in exactly the same fashion as the S.I. described above except that n is equal to 1 instead of 2.5.

In general, materials that have low maximum force values do not necessarily have low values of ΔV and vice-versa. Ideally, one should choose a material where the combination of both parameters are acceptably low, i.e., where the maximum force value is low enough to minimize damage to the teeth, and the ΔV value is low enough so there is minimal brain trauma. Unfortunately, because of the variability in the head size and shape, tooth, bone and muscle structure, etc., absolute values for these two parameters cannot be clearly defined. It is possible, though, to compare the effectiveness of different materials through the analysis of the results of the impact testing. The approach taken here is to measure both parameters, maximum force during impact and ΔV, and calculate a single parameter, a Figure of Merit (FOM). The FOM is defined herein as the product of the maximum force times the absolute value of ΔV. The smaller this value, the more effective the material will be in providing an acceptable combination of force reduction required to protect the teeth, and small velocity difference to protect against concussions. The larger the FOM, the less effective the material will be. Therefore, the FOM provides a convenient parameter to compare one material to another. Specific details of the testing and calculation method are described more fully below.

The objectives of this invention are accomplished through the incorporation of the combination of ePTFE and a selected elastomer. More specifically, the product of the invention is a composite of a film, sheet, or rod, that consists of a layer or layers of expanded PTFE and at least one layer of an elastomer. The thickness of each layer is controlled so that the ratio of the ePTFE layer thickness(es) to that of the elastomer layer thickness(es) is greater than 0.5, preferably greater than 1:1 and less than 50:1, and most preferably between 1:1 and 10:1. The ePTFE may include porous materials with a wide range of densities, including but not limited to the range from 0.1 g/cm$^3$ to 2.0 g/cm$^3$, but preferably in the range of 0.3 g/cm$^3$ to 1.3 g/cm$^3$. The ePTFE may be processed according to the art described in '566, or any commercially available expanded PTFE, including but not limited to Gore-Tex® joint sealant (available from W. L. Gore & Associates), GR™ Sheet (available from W. L. Gore & Associates), Gore-Tex® gasket tape (available from W. L. Gore & Associates), Intertex sheet gasketing (available from Intertex), etc. Additionally, the ePTFE may also be densified to densities as high as 2.0 g/cm$^3$, using for example techniques described in Knox et. al. in U.S. Pat. No. 5,374,473 issued Dec. 20, 1994.

The elastomer layer or layers may include, but are not limited to, natural and synthetic rubbers e.g., polyisoprene and cis-1,4 polyisoprene; polybutadiene and halogenated butyl rubbers; styrene-butadiene rubbers; nitrile or other polyacrylic rubbers; butyl rubbers; ethylene-propylene rubbers including EPM and EPDM; neoprene and hypalon rubbers, polysulfide elastomers; silicones, urethanes, fluorocarbon rubbers, including copolymers and terpolymers containing vinylidene fluoride, hexafluoropropylene, tetrafluoroethylene, propylene, chlorotrifluoroethylene and polymethylvinyl ether; and any of the various thermoplastic elastomers, including but not limited to ethylene vinyl acetate (EVA).

One embodiment of the current invention is a body with a U-shaped cross-section composed of expanded PTFE with an elastomer coating that can be used as a mouth guard.

Figure 3:
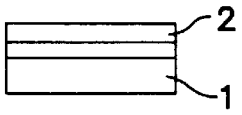
FIG. 3 is a cross-sectional schematic representation of one embodiment of the composite invention.

A second embodiment of the invention is a flat sheet of one or more layers 1 of expanded PTFE and an elastomer 2 as illustrated in FIG. 3. This embodiment can be cut and formed into the shape of shoe insert, athletic padding, padding for protecting mechanical equipment, or any other desired shape. If more than one layer of either the ePTFE or elastomer is used, such multiple layers may be stacked on top of one another or interspersed among one or more layers of the other component, or some combination thereof.

Another embodiment of the invention is a rod of ePTFE coated with an elastomer that can be used in any of the above applications where a circular cross-section is more easily shaped into the desirable final form. One such example is as padding on the inside of athletic, bicycle or other protective helmets. In these applications the round shape can be used to enhance the fit of the helmet, and the smoothness of the ePTFE may lead to a more comfortable feel for the wearer. Any shape composite according to this invention may be used.

The materials of this invention can be used in many and varied applications. Materials of this invention would also provide added value in other areas such as when used with prosthetic devices as an high energy impact absorber between the device and the body.

The materials provided by this invention also provide utility in minimizing impact energy damage in vehicles used for ground transportation. Automotive vehicles (such as cars, trucks, vans, and military vehicles) need to employ such materials in numerous locations to protect the occupants. Such applications include, but are not limited to door panels, body panels, dashboards, steering wheels, seat covers, etc.

The aerospace industry also has significant need for improved impact energy absorbing materials. Within commercial aircraft, such materials can be employed on the fuselage or other interior surfaces to protect passengers from potential injury from sudden unexpected air turbulence or from injury during a crash.

An additional area where the improved damping materials of this invention could be used is the protection of an appliance from damage after being dropped.

Test Methods and Analysis Methods

In order to determine the relative merits of various impact energy absorbing materials, a specific test method was developed to characterize the materials behavior. The test was designed to measure important parameters required to determine the relative merits of any given impact energy absorbing material. The methods allow direct determination of the performance of a specific material and an analytical comparison of its ability to provide protection from a high energy impact.

Figure 4:
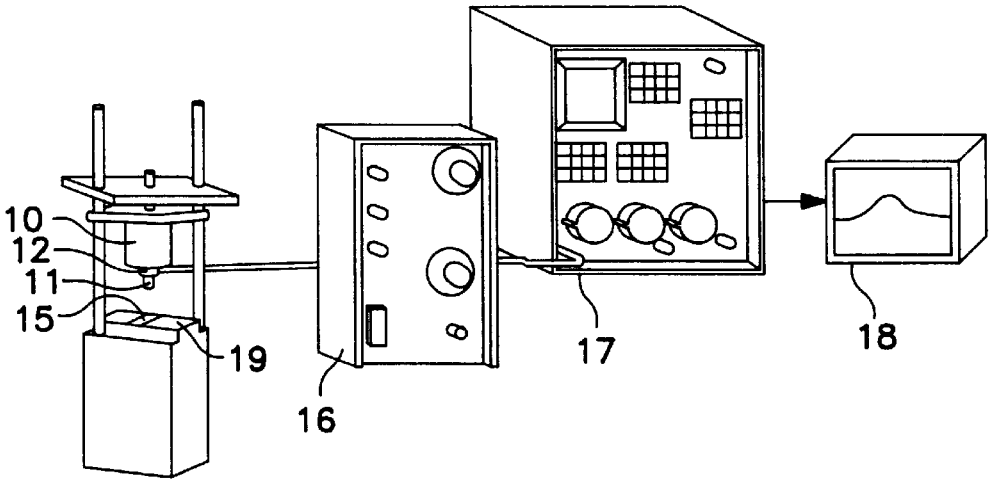
FIG. 4 is a schematic of the test apparatus used to evaluate the materials developed in this invention.

Referring to FIG. 4 (which is not drawn to scale), the tests were run by dropping a 0.5758 kg (2.61 lb) mass 10 containing a force transducer 12 from a height of 0.23 meters (9.1 inches) onto a sample 15 on a rigid base 19. Mass 10 has a circular indentor 11 with a diameter of 8.5 mm attached to it for contacting sample 15. The velocity at impact is calculated from standard laws of motion, velocity being equal to acceleration due to gravity times the distance traveled. The exact value of the initial velocity will depend on the sample thickness, which is normally fixed to be 10.9 mm (0.430")±15%. The initial velocity is then the acceleration due to gravity, 9.80 m/s$^2$, times the distance mass 10 drops, which is 0.23 m less the sample thickness. Moving downward is arbitrarily defined as a negative direction so the velocity on impact is then negative. Behind indentor 11 is a charge type high impedance piezoelectric force transducer 12 (Kistler Instruments, Model 9212) with a nominal impedance sensitivity of 50 pC/lb capable of measuring forces from 0.01 Newtons to 24,000 Newtons (0.001 –5000 lbs). The signal from transducer 12 passes through a dual mode amplifier 16 (Kistler Instruments, Model 5004) to a high speed dual channel analyzer 17 (Nicolet Scientific, Model 660A). The force versus time is subsequently plotted on a digital plotter 18 (Tektronix Model 4662).

Force versus time data is sampled manually from the plot from the time of initial impact through the time that the force first returns to zero. It is then entered into a spreadsheet program (Microsoft Excel) on a personal computer for further analysis. The instantaneous acceleration, at, at each time, t, is calculated from the formula:

$$a_t = F_t / 0.5758$$

where $F_t$ is the force at any time, t. The velocity, $v_t$, at any time, t, can be calculated by numerical integration from $$v_t = v_i + \int_0^t a_t dt$$

where $v_i$ is the initial velocity calculated as described above. Finally, the maximum force and maximum velocity during the impact is determined by scanning the values taken during the entire test. A figure of merit (FOM) that is used as a single number to assess the relative protection that the material under test will provide to high energy impacts is calculated by multiplying the maximum observed force by the absolute value of the difference in maximum and initial velocity.

Each of the embodiments described above may be created through a variety of processes. Various demonstrations of the present invention are included in the Examples immediately following. However, these Examples should be considered as being illustrative and should not be construed as limiting the scope of the invention as defined in the appended claims.

EXAMPLES 1–3

In these examples several composites of an elastomer and expanded PTFE were prepared and their impact energy behavior was measured.

Figure 5:
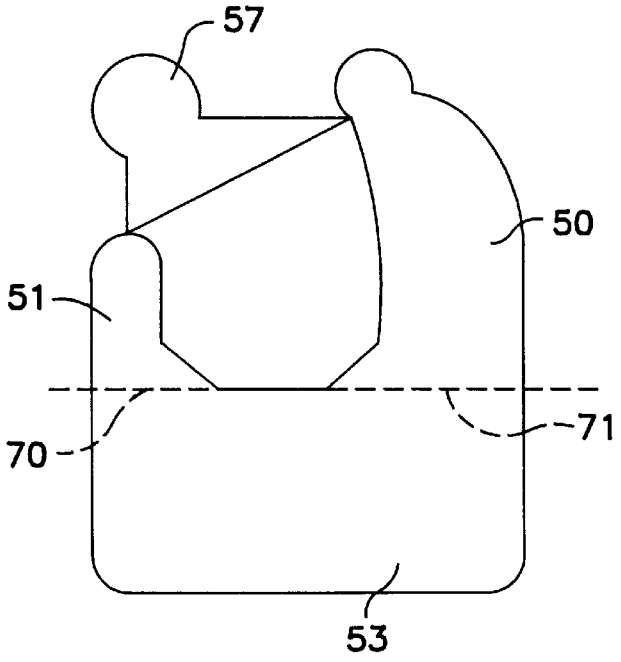
FIG. 5 is a cross-sectional view of an intermediate sample prepared in accordance with an exemplary embodiment of this invention.

An ePTFE material was prepared as follows. A PTFE fine powder resin was thoroughly mixed with mineral spirits at a level of 150 cc mineral spirits per pound of resin. This mixture was paste-extruded through a die at an approximate reduction ratio of 68 to 1. The die used for this extrusion produced an extrudate having a cross-section illustrated in FIG. 5, and which is seen in FIG. 5, the cross-section of the extrudate had a first side 50 taller and wider than a second side 51. First side 50 was approximately 0.938" tall and 0.250" wide (which were the dimensions of the corresponding portion of the die). Second side 51 was approximately 0.625" tall and 0.125" wide (which were also the dimensions of the corresponding portion of the die). The base 53 of the extrudate was approximately 0.750" wide (which was also the dimension of the corresponding portion of the die). The mineral spirits were evaporated by placing the extrudate in a 105° C. oven for 15 hours. A 5" sample was cut from the extrudate.

A gripping clamp was attached to each end of the sample, and the sample was preheated in a 295° C. oven for 30 minutes. The grips of a high rate hydraulic Interlaken test machine were then attached to each of gripping clamps. The grips of the test machine extended into openings on opposite sides (top and bottom) of an oven at 300° C. in which the sample was contained. The sample was then expanded 6.5 times its original length, in the oven at 300° C., by operating the test machine to move the grips apart at a velocity of approximately 1700 mm/s. The oven temperature was then raised to 340° C. As soon as this temperature was reached, the heat was turned off and the chamber door opened to allow cooling.

The sample was removed from the grips and from the oven, and the cap 57 was removed to produce a substantially J-shaped article. This article was weighed, and the weight was divided by the cross-sectional area of the article (calculated from the corresponding dimensions of the die given above) and divided by the article length to calculate the density. The article had a density of approximately 0.3 $g/cm^3$.

For Example 1, a composite sample was prepared by placing an 0.080" thick piece of EVA sheet (Zahn Dental Supply Co.) on top of a rectangular section of ePTFE which was cut from the base of the article (by cutting it along lines 70 and 71 as shown in FIG. 5) to the desired thickness. The rectangular section of ePTFE with the EVA sheet on top of it was placed in a 125° C. oven for approximately 15 minutes with a 19 gram weight placed on the EVA sheet to assist in the bonding. The EVA softened and bonded to the ePTFE.

Figure 6:
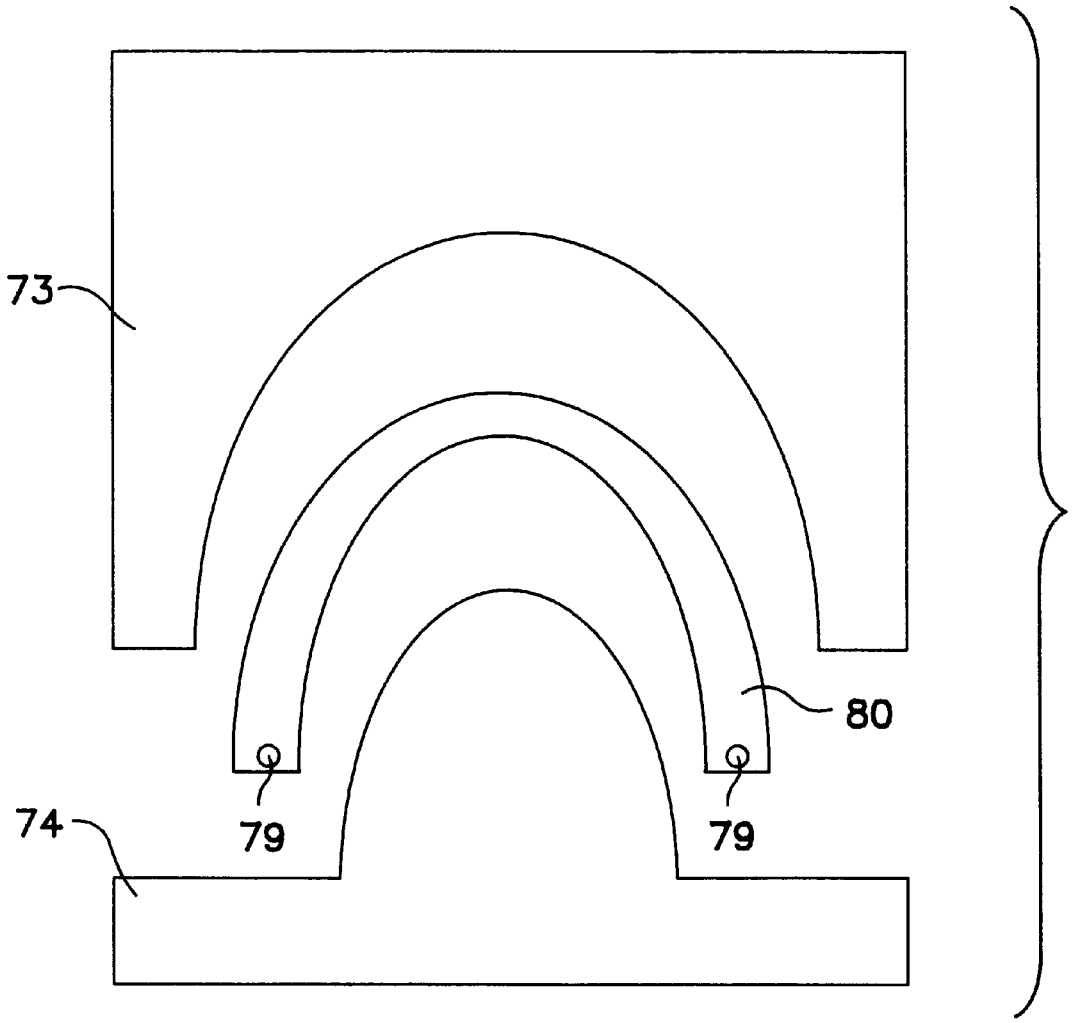
FIG. 6 is a top view of a mold used to fabricate a sample in accordance with an exemplary embodiment of this invention.

Examples 2 and 3 were prepared by bonding GE RTV 615 and Wacker Elastosil® M4644, respectively, onto the ePTFE. To prepare each of these two examples, a 6½" expanded extrudate article, formed according to the method set forth above and having cap 57 removed therefrom, were placed over a horseshoe-shaped form 80, as shown in FIG. 6, with the bottom of the expanded extrudate article facing upward. Pins were placed through the ends of the expanded extrudate article and into pinholes 79 of horseshoe-shaped form 80 to prevent shrinkage of the expanded extrudate article.

A mold having two pieces 73 and 74 was placed around the expanded extrudate article and horseshoe-shaped form 80. The mold extended 0.080" above expanded extrudate article 71. The desired elastomer was potted into the space above the expanded extrudate article. This allowed 0.080" of elastomer to be potted on top of the ePTFE. Excess material was screed off the top of the mold. The apparatus was placed into a 100° C. oven for 15 minutes to cure the elastomer. When the elastomer had cured the mold was disassembled and 1.5" sections cut for impact testing. The sides 50 and 51 were cut off (along lines 70 and 71 as shown in FIG. 5) using a razor blade, leaving a rectangular cross section. The final width and length of these samples were approximately 0.625" and 1.5", respectively.

Impact energy absorption testing for each of these three materials was then performed as described above, and the resulting FOM's are tabulated in Table 1. The FOM's for the composites are much lower than those of the corresponding individual components (shown below as Comparative Examples C-1 through C-4), on the order of one-half that of the elastomer present in the composite (e.g., compare Example 1 to Comparative Example C-1), and approximately 35% to 55% lower than that of the ePTFE component. Therefore the composite materials have much better impact energy absorbing performance than the individual components.

TABLE 1

COMPOSITION AND TESTING RESULTS
EXAMPLES 1–3 AND COMPARATIVE EXAMPLES 1–4

| Ex.# | Composition | Elastomer Thickness (in) | ePTFE Thickness (in) | Total Thickness (in) | FOM (N-m/s) |
|---|---|---|---|---|---|
| 1 | ePTFE/EVA | 0.080 | 0.370 | 0.45 | 1006 |
| 2 | ePTFE/ RTV615 | 0.080 | 0.350 | 0.43 | 886 |
| 3 | ePTFE/ M4644 | 0.080 | 0.350 | 0.43 | 653 |
| C-1 | EVA | 0.430 | 0 | 0.43 | 2631 |
| C-2* | RTV 615 Silicone | 0.430 | 0 | 0.43 | 1556 |
| C-3 | M4644 Silicone | 0.430 | 0 | 0.43 | 1153 |
| C-4* | ePTFE | 0 | 0.430 | 0.43 | 1,469 |

*Reported value is the average from FOM tests of two different samples of the same composition

Conparative Examples C-1–C-4

In these examples, the impact energy behavior of the individual components used in Examples 1–3 are measured to show that the composite materials have better protective properties than any of the individual components of the composite.

Comparative Example C-1 was prepared by layering four pieces of the EVA sheet used in Example 1 to obtain the desired final thickness of 0.430". The pile was placed in a 125° C. oven for fifteen minutes to allow the EVA sheets to soften and bond to each other. A weight of approximately 19 grams was placed on top of the pile to assist in the bonding.

For Comparative Examples C-2 and C-3, two different elastomers were prepared as follows: addition cure elastomers RTV 615 (GE Silicones) and Elastosil® M4644 (Wacker Chemicals) were potted using an apparatus that controlled the depth of the potting. The apparatus was a plastic cylinder approximately 3 inches in diameter fitted with a tight plastic piston. Spacers were placed on the piston and the apparatus placed in a hydraulic press. A load sufficient to push the piston to a desired depth was manually applied to the piston. This depth corresponded to the desired thickness of the elastomer, in this case 0.430". The elastomer and curing agent were mixed at a 10 to 1 ratio by weight and were poured into the cavity and screed level with the top. The elastomers were cured in a 100° .C oven for approximately 30 minutes.

Comparative Example C-4 was simply a sample of the base of the ePTFE extrudate described above in Example 1.

Impact energy absorption testing for each of these four materials was then performed, and the resulting FOM's are shown in Table 1. The FOM's for the individual components are much higher than the inventive composites described in Examples 1–3.

EXAMPLES 4–9

In Example 4, a 0.420" thick ePTFE extrudate was formed according to Example 1 (using the base of the extrudate). The elastomer was simply brushed onto the surface and then placed in a 100° C. oven for 10 minutes to cure the elastomer. This produced an elastomer thickness of approximately 0.008".

In Examples 5–8, the ePTFE component of the composites were prepared in desired thicknesses (see Table 2) according to Example 1. The elastomer, RTV 615, was potted at depths of 0.040", 0.110", 0.215", and 0.290", as described in Example C-2. While the curing elastomer was still tacky the corresponding thickness of ePTFE (Table 2) was laid on top of it to obtain the desired final thickness of 0.430". Excess elastomer was trimmed from the sides. Each specimen used for impact tests was approximately 1.5" long by 0.625 wide.

In Example 9, a 0.040" thick section of ePTFE was obtained from an extruded tape. These tapes (Gore-Tex® Gasket Tape, W. L. Gore and Associates, Elkton, Md.) are commercially available with a density of approximately 0.6 g/cc. A one inch strip approximately 12 inches long was cut from a roll of such tape. This strip was placed between clamps and preheated at 295° C. for 10 minutes. It was then expanded at a velocity of 2 mm/sec and a ratio of 2 to 1 to reduce its density to approximately 0.3 g/cc. It was then heated to 340° C. and immediately removed from the oven. A piece approximately 0.625" wide by 1.50" long was bonded to RTV 615 as in Examples 5 through 8.

Multiple samples were prepared and tested for some of the compositions as noted in Table 2. The results from the impact energy testing on each of these compositions is presented in Table 2.

For a composition of ePTFE thickness to elastomer thickness of 0.1, the value of the FOM of 1572 is very close to the FOM of the pure component, silicone, of 1556 from Comparative Example C-3. Therefore, testing of compositions with ratio lower than 0.1 should be expected to yield values very close to these. Furthermore, it is difficult to prepare materials with ratio lower than 0.1 both because the ePTFE becomes very thin and hard to handle, and because the elastomer tends to infiltrate into and through the thin ePTFE during bonding of the two layers. In such a case, the composite is not truly the separate layers of ePTFE and elastomer of this invention, but rather a thicker layer of elastomer and a thin layer of an elastomer-ePTFE composite blend.

TABLE 2 ePTFE/RTV 615 SILCONE COMPOSITIONS

| Ex.# | # of Tests | ePTFE Thickness (in) | Elastomer Thickness (in) | ~ePTFE to Elastomer Ratio | Total Thickness (in) | Mean FOM (N-m/s) | Std. Dev of FOM |
|---|---|---|---|---|---|---|---|
| 4 | 5 | 0.420 | 0.008 | 50:1 | 0.43 | 1094 | 132 |
| 5 | 5 | 0.390 | 0.040 | 10:1 | 0.43 | 1531 | 73 |
| 6 | 4 | 0.320 | 0.110 | 3:1 | 0.43 | 1059 | 416 |
| 7 | 4 | 0.215 | 0.215 | 1:1 | 0.43 | 1248 | 211 |
| 8 | 1 | 0.140 | 0.290 | 0.5:1 | 0.43 | 1161 | — |
| 9 | 1 | 0.040 | 0.390 | 0.1:1 | 0.43 | 1572 | — |

Comparative Example C-5

As one example to show that the instant invention is clearly superior to materials available previously, the impact energy absorption of materials made according to U.S. Pat. No. 5,429,869 issued Jul. 4, 1995 were measured. A sample of a material prepared according to Example 6a in U.S. Pat. No. 5,429,869 was tested to determine its impact energy absorption behavior. The sample had approximate dimensions of 0.430" thick by 0.750" wide by 2.00" long and had a density of approximately 0.047 g/cc. The results produced an FOM equal to 28,295. Clearly this value is much greater than any of those in the previous examples of the inventive composites, thereby illustrating that the impact absorption characteristics of the instant invention are superior to such foamed PTFEs.

EXAMPLE 10

One of the features of the instant invention is that it can survive repeated high energy impacts and still offer protection against subsequent impacts. To demonstrate this advantage the high energy impact testing was performed on the inventive material in the same location three different times. The FOM was recorded after each impact. The test material was prepared as described for Example 6, having a thickness ratio of ePTFE to RTV 615 silicone of 3:1. The results recorded in Table 3 demonstrate that although the impact energy absorption has degraded somewhat after each impact, the extent of degradation is far less than foamed thermoplastic materials (Comparative Example C-6) or ePTFE itself (Comparative Example C-7). After the third impact, the FOM of the inventive composite is lower than the FOM of a commonly used impact energy absorbing commercial material, EVA, from the first impact, (see Comparative Example C-1 in Table 1). The tests showed little or no permanent damage on the impacted surface of the inventive composite (A), Example 10; some permanent impact damage on the ePTFE material (B) of Comparative Example C-7; and extensive permanent damage in the styrofoam (C) of Comparative Example C-6.

Comparative Examples C-6–C-7

The effect of multiple impacts on styrofoam and ePTFE were examined in Comparative Examples C-6 and C-7, respectively, as a means of comparison for Example 10. The styrofoam was purchased from a local craft store and cut to a thickness of 0.50". The density of this material was approximately 0.03 g/cc. The ePTFE was prepared as described in Comparative Example C-4 having an initial thickness of 0.43" and a density of approximately 0.3 g/cm$^3$. The results (Table 3) confirm the inability of styrofoam and ePTFE to maintain effective impact energy absorbtion behavior after repeated impacts when compared to the instant invention illustrated in Example 10.

TABLE 3

Effect of Multiple Impacts on Various Materials

| Ex. # | Composition | Total Initial Thickness (in) | FOM After 1st Impact (N-m/s) | FOM After 2nd Impact (N-m/s) | FOM After 3rd Impact (N-m/s) |
|---|---|---|---|---|---|
| 10 | 3:1 ePTFE /RTV 615 | 0.430 | 689 | 1518 | 2313 |

TABLE 3-continued

Effect of Multiple Impacts on Various Materials

| Ex. # | Composition | Total Initial Thickness (in) | FOM After 1st Impact (N-m/s) | FOM After 2nd Impact (N-m/s) | FOM After 3rd Impact (N-m/s) |
|---|---|---|---|---|---|
| C-6 | Styrofoam | 0.500 | 10,465 | 51,516 | 57,547 |
| C-7 | ePTFE | 0.430 | 1606 | 6346 | 10,562 |

EXAMPLE 11–12

In some applications materials used for protection against high energy impacts will be compressed by a fixed load prior to a high energy impact. For example, mouth guards will be compressed by biting, and shoe inserts by prolonged standing. In both cases, subsequent impact energy absorption could be reduced. In these examples, the inventive compositions will be shown to retain a large fraction of their impact energy absorption characteristics after such compression.

Examples 11 and 12 were made from materials prepared according to the procedures described above for Example 2. One piece (Example 11) was not compressed and retained it's thickness of 0.430". One piece (Example 12) was compressed to approximately ½ of the original thickness of 0.430". This sample was compressed using a hydraulic press with spacers controlling the distance between the platens. Due to some rebound the thickness of Example 12 was approximately 0.230". The precompression reduces the impact energy absorption behavior of the inventive composite as seen by the higher FOM (Table 3A). Even after this severe precompression, though, the FOM of the inventive composite is lower (better) than the FOM of a commonly used impact energy absorbing commercial material, EVA, from the first impact, (see Comparative Example C-1 in Table 1).

TABLE 3A

Effect of Precompression on ePTFE/RTV 615 Silicone Compositions

| Ex.# | Precompression | Final Total Thickness (in) | FOM (N-m/s) |
|---|---|---|---|
| 11 | None | 0.430 | 886 |
| 12 | ~½ original thickness | 0.230 | 1557 |

EXAMPLES 13–16

Examples 13 through 16 compare compositions when the total thickness and ratio of ePTFE to elastomer is held constant while the density of the PTFE is varied.

Example 13 was prepared the same as Example 6.

Example 14 was prepared by compressing a piece of 1" joint sealant (W.L. Gore and Associates Elkton, Md.) to a thickness of 0.320" and bonding it to GE RTV615 as in Example 6. This produced a PTFE density of approximately 0.6 g/cc.

Example 15 was prepared by expanding a rectangular (0.500"×0.600") cross section of extrudate as was made using the procedure in 566. A piece approximately 6" long was preheated in a 295° C. oven for 30 min. then expanded in a 300° C. oven to 1.3 times its original length using a high rate hydraulic test machine (Interlaken Corporation) operating at a velocity of approximately 2 mm/s. The oven temperature was then raised to 340° C. As soon as this temperature was reached, the heat was turned off and the chamber door opened to allow cooling. This produced a PTFE density of approximately 1.3 g/cc. A section approximately 0.320" thick by 0.600" wide by 1.50" long was bonded to 0.110" of RTV 615 as in Example 6.

Example 16 was prepared by using an engine lathe to part a 0.320" thick piece from commercially available PTFE round stock as is sold by Kaufman Glass Co. of Wilmington, Del. The parted section was then cut on a band saw to produce a piece approximately 1" wide×1½" long. This piece was then joined to the GE RTV615 as is described in Example 6. The density of the commercially available PTFE was approximately 2 g/cc.

The FOM results show that the density of the PTFE does have an effect on the impact energy absorbing behavior of the inventive composites. Nevertheless, the impact energy behavior of the composites prepared with ePTFE with density less than 2.0 g/cm$^3$ is better than the individual components, RTV 615 and ePTFE as shown in Comparative Example C-2 and Comparative Example C-4, respectively. Even with higher density PTFE represented by Example 16, the FOM is significantly lower than the FOM of a pure PTFE material (Comparative Example C-8).

TABLE 4

Effect of PTFE Density of the Impact Energy Resistance of PTFE /RTV 615silicone

| Ex.# | Elastomer Thickness (in) | PTFE thickness (in) | PTFE density (g/cc) | Total thickness (in) | FOM (N-m/s) |
|---|---|---|---|---|---|
| 13 | 0.110" | 0.320" | 0.3 | 0.430" | 709 |
| 14 | 0.110" | 0.320" | 0.6 | 0.430" | 1348 |
| 15 | 0.110" | 0.320" | 1.3 | 0.430" | 1422 |
| 16 | 0.110" | 0.320" | 2.0 | 0.430" | 5071 |
| C-8 | 0 | 0.25" | 2.0 | 0.25" | 6512 |

Comparative Example C-8

Comparative Example C-8 was prepared from a commercial 0.25" PTFE sheet as sold by Kaufman Glass Co. of Wilmington, Del. A~1"×2" piece was cut from the sheet with metal cutting shears. The density of the commercially available PTFE was approximately 2 g/cc. The FOM of this material was subsequently tested for comparison to Example 16.

EXAMPLE 17

Example 17 was made using sections cut out of the base material as explained in Examples 6 through 9. The ratio of ePTFE to GE RTV615 was 1:1 but there were four layers instead of two as in Example 7. Pieces 0.110" thick were cut from the base material and joined with 0.110" thick GE RTV 615 as in Examples 6 through 9. This produced a laminate 0.220" thick. Two of these laminates were then joined by brushing a thin layer of elastomer onto the ePTFE side of one laminate and placing the elastomer side of the other laminate on top of it. The entire sandwich was then placed in a 100° C. oven for 10 minutes to cure the elastomer. A small weight was placed on top of the pile to assist in the bonding. This produced a four layer laminate approximately 0.440" thick. Three samples were prepared and each was tested. The mean value from the three tests for the FOM for this composite was 1046 N-m/s with the standard deviation equal to 18. This value is lower but comparable to the FOM of a material with the same thickness ratio of ePTFE to elastomer but with two layers instead of four, (see Example 7 in Table 1).

Although described in connection with specific examples, the present invention is not intended to be limited thereto, but rather includes such modifications and variations as are within the scope of the appended claims.

What is claimed is:

1. An impact energy absorbing article comprising:

a) a layer of polytetrafluoroethylene (PTFE) having a PTFE layer thickness and a density less than about 2.0 g/cm$^3$, and b) a layer of an elastomer having an elastomer layer thickness, wherein a ratio of said PTFE layer thickness to said elastomer layer thickness is greater than or equal to 0.5.

2. The impact energy absorbing article of claim 1 wherein said ratio is greater than one.

3. The impact energy absorbing article of claim 1 wherein said ratio is greater than three.

4. The impact energy absorbing article of claim 1 wherein said ratio is greater than ten.

5. The impact energy absorbing article of claim 1 wherein said elastomer selected from the group consisting of polyisoprene, cis-1,4 polyisoprene, polybutadiene, halogenated butyl rubber, styrene-butadiene rubber, polyacrylic rubber, butyl rubber, ethylene-propylene rubber, neoprene rubber, hypalon rubber, polysulfide elastomer, silicone, urethane, fluorocarbon rubber, hexafluoropropylene, tetrafluoroethylene, propylene, chlorotrifluoroethylene, polymethylvinyl ether, and thermoplastic.

6. The impact energy absorbing article of claim 1 wherein said PTFE is expanded PTFE and has a fibril and node structure or remnants thereof as characterized by peaks at about 327° C. and about 380°0 C. in a thermogram of differential scanning calorimetry in the course of a temperature rise of 10° C./min.

7. The impact energy absorbing article of claim 6 wherein said density is less than 1.5 g/cm$^3$.

8. The impact energy absorbing article of claim 6 wherein said density is less than 1.0 g/cm$^3$.

9. The impact energy absorbing article of claim 6 wherein said density is less than 0.5 g/cm$^3$.

10. The impact energy absorbing article of claim 1 further comprising a plurality of said layers of PTFE and wherein said ratio is of a sum of the ePTFE layer thicknesses of said plurality of PTFE layers to said elastomer layer thickness.

11. The impact energy absorbing article of claim 1 further comprising a plurality of said layers of elastomer and wherein said ratio is of said PTFE layer thickness to a sum of the elastomer layer thicknesses of said plurality of elastomer layers.

12. The impact energy absorbing article of claim 1 further comprising a plurality of said layers of PTFE and a plurality of said layers of elastomer, and wherein said ratio is of a sum of the PTFE layer thicknesses of said plurality of PTFE layers to a sum of the elastomer layer thicknesses of said plurality of elastomer layers.

13. The impact energy absorbing article of claim 1 wherein said article is a mouth-guard.

14. The impact energy absorbing article of claim 1 wherein said article is an athletic padding material.

15. The impact energy absorbing article of claim 1 wherein said article is a component of a shoe.

16. The impact energy absorbing article of claim 1 wherein said article is a prosthetic device.

17. The impact energy absorbing article of claim 1 wherein said article is a protective helmet.

18. The impact energy absorbing article of claim 1 wherein said article is padding to protect mechanical equipment.

19. The impact energy absorbing article of claim 1 wherein said article is a protective material on the interior of an automobile or other moving vehicle.

20. The impact energy absorbing article of claim 1 wherein said ratio is between 1:1 and 50:1.

21. The impact energy absorbing article of claim 1 wherein said ratio is between 1:1 and 10:1.

* * * * *